US006106218A

United States Patent [19]

Schubart et al.

[11] Patent Number: 6,106,218

[45] Date of Patent: Aug. 22, 2000

[54] APPARATUS FOR THE VERTICAL STACKING OF PRINTED PRODUCTS

[75] Inventors: Ralf-Peter Schubart, Kochel; Karlheinz Hiemer, Grünwald, both of Germany

[73] Assignee: Hagen Gammerler, Icking, Germany

[21] Appl. No.: 08/863,760

[22] Filed: May 27, 1997

[30] Foreign Application Priority Data

May 29, 1996 [DE] Germany ..... 196 21 564

[51] Int. Cl.[7] ..... B65G 57/03; B65H 31/08

[52] U.S. Cl. ..... 414/790.2; 414/790.4; 414/790.8; 414/907; 271/220; 271/218

[58] Field of Search ..... 414/789.5, 790.2, 414/790.4, 790.8, 794.4, 907; 271/218, 220

[56] References Cited

U.S. PATENT DOCUMENTS

| | | | |
|---|---|---|---|
| 3,115,090 | 12/1963 | Elander . | |
| 4,432,685 | 2/1984 | Stauber . | |
| 4,451,191 | 5/1984 | Torre | 414/790.4 |
| 4,527,936 | 7/1985 | Hartlieb | 414/790.4 |
| 4,538,511 | 9/1985 | Wise . | |
| 4,657,465 | 4/1987 | Aoki | 414/907 |
| 4,725,180 | 2/1988 | Kasamatsu et al. | 414/31 |
| 4,921,397 | 5/1990 | Watanabe | 414/790.4 |
| 5,370,382 | 12/1994 | Wetter | 271/218 |
| 5,387,077 | 2/1995 | Yatsuka et al. | 414/907 |
| 5,447,410 | 9/1995 | Hast et al. | 414/907 |
| 5,558,318 | 9/1996 | Crowley et al. | 414/907 |

FOREIGN PATENT DOCUMENTS

| | | | |
|---|---|---|---|
| 0 550 758 | 7/1993 | European Pat. Off. . | |
| 28 27 540 | 11/1979 | Germany . | |
| 31 26 807 | 3/1982 | Germany . | |
| 31 26 807 A1 | 3/1982 | Germany . | |
| 31 25 370 A1 | 9/1982 | Germany . | |
| 44 08 780 A1 | 9/1995 | Germany . | |
| 2-169468 | 6/1990 | Japan | 414/790.4 |
| 2 155 909 | 10/1985 | United Kingdom . | |

*Primary Examiner*—Douglas Hess
*Attorney, Agent, or Firm*—Fitch, Even , Tabin & Flannery

[57] ABSTRACT

An apparatus for the vertical stacking of printed products has a precollecting device with a collecting shaft and a precollecting support, with at least two stacking baskets being arranged on a carousel. The apparatus is provided with a first holding down device and with a second holding down device on the carousel.

19 Claims, 4 Drawing Sheets

APPARATUS FOR THE VERTICAL STACKING OF PRINTED PRODUCTS

FIELD OF THE INVENTION

The present invention relates to an apparatus for the substantially vertical stacking of printed products.

DESCRIPTION OF THE PRIOR ART

A pile stacker for folded printed sheets is known from DEA-31 26 807 in which the printed sheets are thrown down into a prestacking device at the end of a conveyor path. Above this prestacking device there is provided a device for the laying in of end plates. A lowering unit is movable upwardly and downwardly in the lower region in which the stack, i.e. the so-called "pile" is formed, with a pressing device and a binding device also being provided at this position.

A packing machine is known from U.S. Pat. No. 3,115,090 which uses a rotary table which can be loaded and unloaded from its underside. A prestacked partial stack is pushed from a prestacking device onto a lifting table which conveys the prestack upwardly into the rotary table. After achieving a predetermined number of partial stacks, the table rotates and an empty collecting shaft takes the place of the full one. The filled collecting shaft is rotated into a pressing station in which manual or automatic binding can also take place.

A vertical stacker is known from DE-A-31 25 370 in which the prestacking device is formed as a carousel. Here, the base of the stacking basket is formed in the shape of a lifting table which can be hydraulically lifted and lowered.

OBJECT OF THE INVENTION

It is the object of the invention to provide an apparatus for the vertical stacking of printed products which with a compact construction ensures a rapid and reliable manner of operation.

BRIEF DESCRIPTION OF THE INVENTION

The solution of this object is achieved by an apparatus for the vertical stacking of printed products comprising

- a precollecting device with a collecting shaft and a precollecting support
- at least two stacking baskets arranged on a carousel,
- a pressing fork which is arranged peripherally and stationary,
- a first holding down device which is arranged in the region of the precollecting device, and
- a second holding down device which is arranged on the carousel.

A continuous formation of stacks, so-called piles, can take place at the highest speeds through the stacking baskets arranged on the carousel. After the completion of a pile, the carousel is turned and the filled stacking basket is located beneath the pressing fork arranged at the periphery and stationary, so that the pile which is located therein can be compressed. At the same time an empty stacking basket is now located beneath the precollecting device which can be filled. Thus, in accordance with the invention, pressing takes place not in the area of the precollecting device, but rather in a pressing station formed separately from it.

Through the two holding down devices which are provided in the area of the precollecting device and on the carousel a straight alignment of the pile, i.e. of the printed products which are stacked on top of one another, can be achieved in accordance with the invention. Since the apparatus of the invention does not provide for any crossed laying of the products to be stacked, "upward bending" can arise from a certain number of products lying on top of one another onwards. This can occur in particular with printed products with a fold as a result of the fold if the upper side of the pile is not held from above. During the filling of a collecting shaft with the precollecting device this holding down function is executed by the continuously following products. However, when an irregularity occurs in the product flow entering into the precollecting device, for example because the desired pile height has been achieved, then the filling pressure reduces since the pile which has been formed sinks further, but no further products follow from above. In order to avoid an upward bending of the upper region of the stack at this point in time, i.e. in order to maintain a flat surface of the pile or stack, the first holding down device in accordance with the invention is provided which at this point in time acts on the upper side of the pile and holds down the uppermost printed products. A second holding down device is provided, so that the positive action of this first holding down device is not lost during the transport of the stack to the pressing station. The second holding down device is arranged on the carousel and continues to hold down the stack or pile which is formed during the transport to the pressing station. Thus, the stacked pile cannot expand or bend upwardly anywhere from the start up to the pressing operation and the subsequent banding, whereby a completely straight pile is created which does not produce any wastage during the later further processing.

Advantageous embodiments of the invention are described in the subordinate claims, in the description and in the drawings.

Thus, the first holding down device can have a plurality of hold-down members which are arranged at different sides of the collecting shaft. In this way, the upper side of the pile is held down uniformly because the hold-down members are pressed onto the upper side of the pile on the various sides of the collecting shaft. In the same way the second holding down device can have several hold-down members which are arranged at different sides of the stacking baskets. This also results in an absolutely flat, i.e. horizontal alignment of the upper side of the pile and thus on the whole to a straight and flush alignment of the pile.

In accordance with a further advantageous embodiment, the first holding down device is axially movable in the region of the collecting shaft and also downwardly beyond the collecting shaft. In this way, the prestack which is formed in the collecting shaft can indeed still be held down when the stack has already left the collecting shaft or the precollecting device. it is also advantageous when the first holding down device is movable into a position above a product supply because then this holding down device can be lowered very rapidly in order to hold down the uppermost product of a pile which is to be formed.

In accordance with a further embodiment of the invention the second holding down device is axially movable, with its path of movement overlapping the axial path of movement of the first holding down device. In this way the top side of the pile which is formed can be continually held down, both in the region of the precollecting device and also after leaving the precolleting device and during the further transport on the carousel, because the two holding down devices alternate. In this respect the stationary, first holding down device is initially effective until the pile has left the precollecting device. Following this, the second holding down device which is movable on the carousel can become active and the first holding down device can be deactivated.

It is particularly advantageous in this arrangement when the axial path of movement of the second holding down device goes beyond the upper edge of the stacking baskets, since then the region of overlap between the two holding down devices is formed in the intermediate space between the precollecting device and the stacking basket.

In accordance with a further embodiment of the invention an end plate supply can be provided which is arranged above the lower end point of the first holding down device and preferably above the upper end point of the second holding down device. Through an end plate supply arranged in this way, an upper end plate can be supplied so that it initially lies on the fully lowered, upper, holding down device. Following this, the second holding down device can be activated so that this presses against the laid-on upper end plate. Following this, the first holding down device can be deactivated, i.e. the associated hold-down members can be removed from the pile so that the pile is only held down by the second holding down device which, however, now no longer contacts the topmost product, but rather the top end plate.

The holding down devices can have at least one laterally pivotable plate and at least one pivotable hook as hold-down members. The laterally pivotable plate can be advantageously used at positions of the stack at which the stack does not produce any internal forces which are too large, for example at the side opposite to the fold. Vice versa, a pivotable hook can be advantageously used at the fold side of a printed product, since there the forces which arise are larger and can be better compensated by a pivotable hook as a result of the lever ratios.

A further advantageous embodiment is present when the means for supplying end plates has an end plate dispensing device which is arranged between a precollecting device and a stacking basket located in the carousel in the filling position. Through this particular arrangement, a very simple introduction of an end plate is possible because adequate time remains during the precollecting in the precollecting device in order to bring an empty stacking basket into position on the one hand and to move a lowering device up into its receiving position on the other hand. The end plate dispensing device is advantageously arranged at the level of the upper waiting position of the lowering device and is thus located beneath a precollecting support which is arranged in the collecting shaft. The end plate can thereby be deposited undisturbed onto a lowering device while the already formed part stack is still held by the precollecting support of the precollecting device.

In accordance with a further embodiment of the invention a contact pressure band can be provided which is arranged substantially above the precollecting device. In this way a particularly good alignment of the printed products in the collecting shaft is ensured because the individual printed products do not simply "fall into" the collecting shaft, but are rather drawn off from the conveyor track with the aid of the contact pressure band and moved up to an inner wall of the precollecting shaft.

Of advantage is a manner of operation in which the lowering device is moved upwardly to the receiving position directly after a filled stacking basket has left the filling position, with the lowering device adopting its receiving position at the same time as or shortly before an empty stacking basket has reached the filling position. In this arrangement it is advantageous when the stacking basket has a cut-out for the lateral passage of a lowering fork in the upper region of its front side wall in the direction of rotation. Through a measure of this kind, a rapid filling cycle of the stacking basket is possible. The lowering speed of the lowering fork which can be moved upwardly and downwardly by means of a chain drive is advantageously variably controllable in dependence on the speed of the product stream and on the operational sequence of the precollecting support.

BRIEF LISTING OF THE FIGURES

In the following the present invention will be described purely by way of example and with reference to advantageous embodiments and to the accompanying drawings, with it being expressly pointed out that the individual features of the invention can also be advantageous independently of the remaining features.

There are shown:

FIG. 1 a schematic illustration of an apparatus for the vertical stacking of printed products, FIG. 2 a plan view of the carousel with the stacking baskets, FIG. 3 an enlarged illustration of the precollecting device, FIG. 4 a schematic illustration of the positions of the hold-down members on a stack of printed products.

DESCRIPTION OF THE PREFERRED EMBODIMENTS

Figure 1:
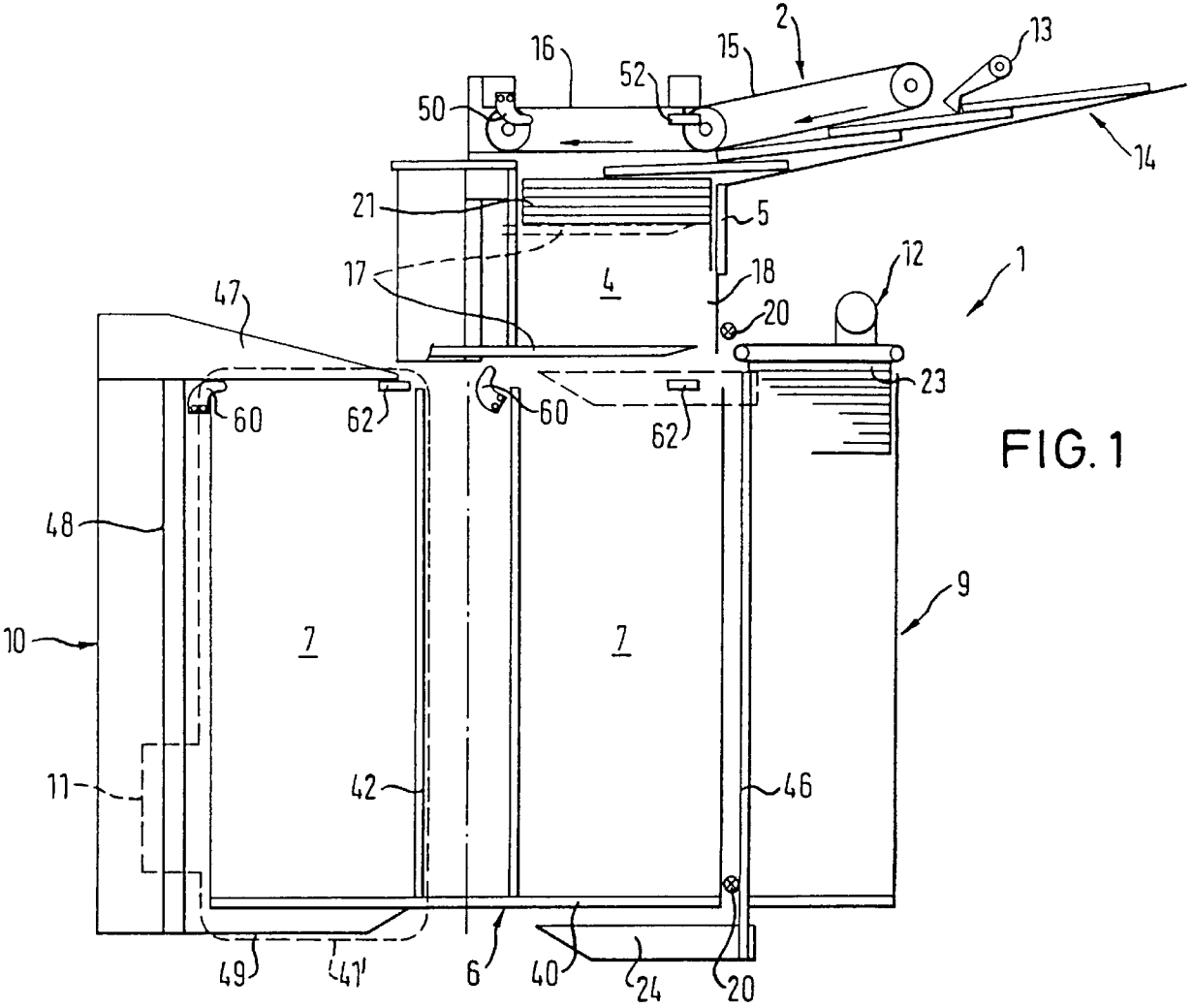

The apparatus shown in FIG. 1 for the stacking of printed products delivered in an overlapping stream 14 has a run-in arrangement 2 and following it and arranged somewhat beneath it a precollecting device 4. Before the run-in arrangement 2 there is arranged a delay device 13 which produces an irregularity in the overlapping formation of the products through sequence control.

The precollecting device 4 is equipped with a vertically movable precollecting support in the form of a rake 17 which can be moved into the overlapping stream and can be drawn out of the drop shaft 18 of the precollecting device 4 after having reached a lowermost position. In the upper region of the precollecting shaft 18 there is arranged a layer shaking device 5 which aligns the region of the precollected stack which is transported past it.

The stacking apparatus shown in FIG. 1 furthermore has two stacking baskets 7 arranged on a carousel 6 which are arranged diametrically opposite to one another in the described embodiment. A lowering device 46 cooperates with the (right hand) stacking basket 7 arranged in the filling position and has an upwardly and downwardly movable lowering fork 24. The lowering fork 24 projects during the stacking procedure into the shaft of the stacking basket 7 and can pass downwardly through the correspondingly designed base 40 of the stacking basket.

At the side opposite to the filling position the stacking basket 7 is located in its pressing position and cooperates at this position with a pressing unit 10. Associated with the pressing unit 10 is a binding or banding unit 11 with which a packaging band or tape is placed around the product stack located in the (left hand) stacking basket 7 after it has been pressed together.

The lowering device 46, the pressing unit 10 and the binding unit 11 are provided in a stationary and peripheral arrangement, in satellite-like manner, outside of the carousel apparatus 6, at the edge of the path of movement of the stacking basket 7.

FIG. 1 furthermore schematically shows an end plate lifting device 9 which is likewise of stationary position and which represents an important element of a device for the laying in of end plates. The end plate lift is designed in the manner of a paternoster lift and is arranged radially behind the lowering device 46. In this respect it extends sideways essentially over the height of the stacking basket 7.

A device for the supply of end plates is arranged above the plate lift 9. In relationship to the overall system, this device 12 is located between the precollecting device 4 and a stacking basket 7 located in the carousel apparatus 6 in the filling position. In this arrangement the end plate supply device 12 is arranged at the level of the upper position of the lowering fork 24 and also of the waiting position of the plate lift 9. It has a conveyor belt arrangement which extends from the plate lift 9, over the lowering mechanism up to the shaft of the stacking basket 7. The conveyor belt arrangement conveys, by means of a toothed belt, an end plate 23 which is being pressed against the toothed belt from below. The conveying of the end plate can take place—either by rear engagement by means of a follower or, with a corresponding design of the side facing the plate stack, by frictional engagement—over a rail guide onto the lowering fork 24 which is already located in the waiting position in the stacking basket 7 at the same level as the rail guide.

Figure 2:
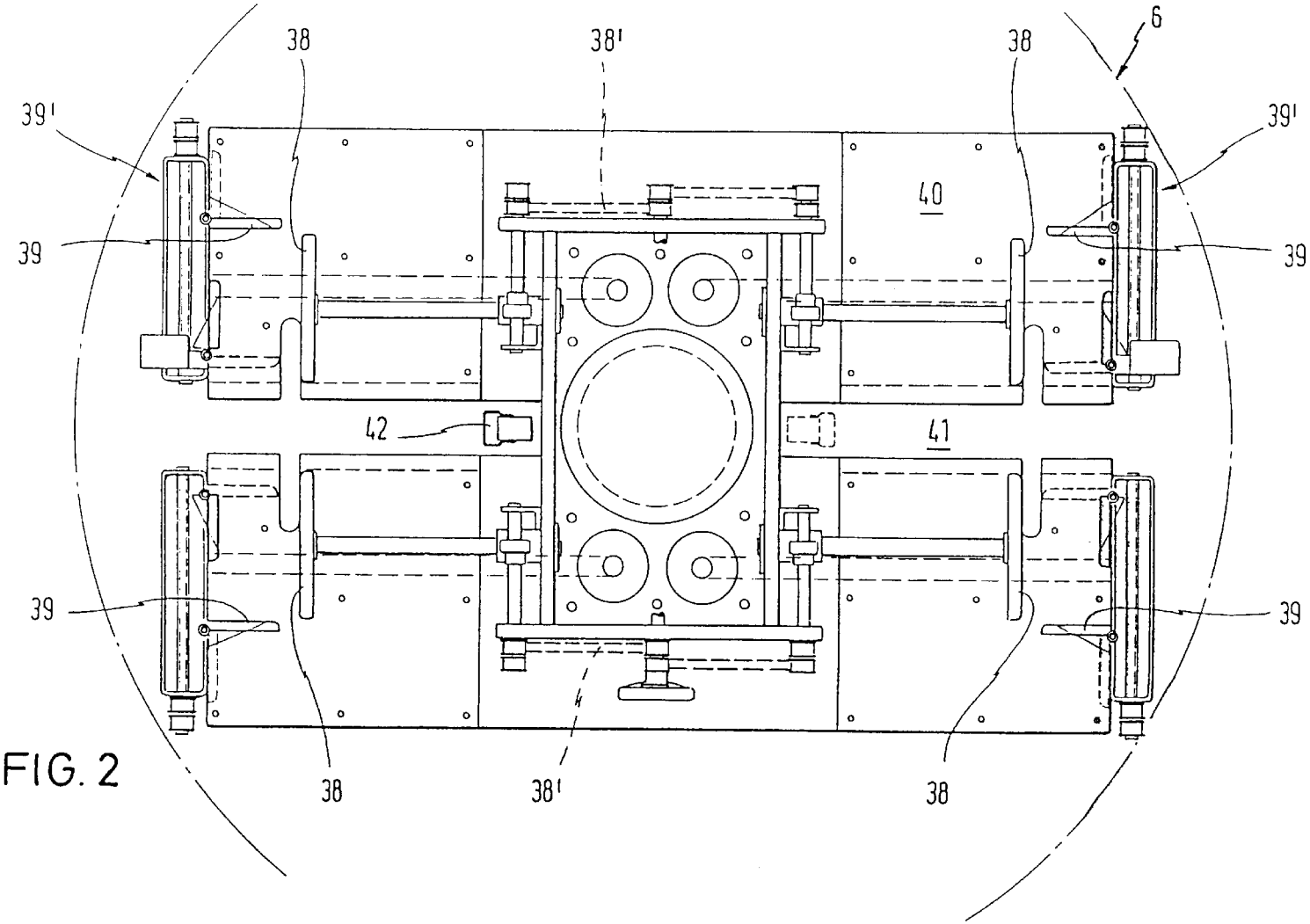

FIG. 2 shows a plan view of the stacking baskets which are located on the carousel device 6. One stacking basket is in this arrangement formed essentially as a shaft with a fixed base 40, an adjustable rear wall 38 and adjustable or outwardly pivotable side walls 39, i.e. the stack is guided at all sides in the stacking basket. The side walls 39 are made laterally outwardly pivotable in order to be able to push the pile sideways out of the stacking basket after binding (banding) has taken place.

For the adjustment of the walls 38, 39 there is in each case provided a manually and/or power driven combined toothed belt/rack and pinion drive or a threaded transmission 38', 39'.

The adjustment of the respective rear walls 38 of two stacking baskets 7 or the adjustment of mutually associated side walls 39 of a stacking basket takes place in each case synchronously in such a way that on actuating the corresponding drive, both rear walls 38 are simultaneously displaced. The side walls 39 behave in just the same way so that on actuation of the corresponding positioning drive both side walls of a basket can be simultaneously set.

The base 40 of the stacking basket 7 has a through-opening 41 for the lowering fork 24. The through-opening 41 is so dimensioned in this arrangement that adequate space is also present in a packaging position for a binding tape to be placed around the pile. A sheet metal slide is screwed onto the base 40, which enables the pile to be pushed out of the basket easily. Slide tracks are mounted beneath the base 40 and, in cooperation with guide members of the apparatus, permit the carousel to rotate.

As FIG. 2 shows, a guide channel 42 for the packaging or binding tape is formed as an independent unit in the region of the rear wall and retains its position unchanged, even with a displacement of the rear wall. In this way it is ensured that the binding device 11 can remain an uncomplicated construction, since it does not have to be adapted to a change in the size of the product.

The lowering fork 24, which cooperates with the stacking basket 7 in its filling position, is upwardly and downwardly movable by means of its own chain drive. In a modification side wall cut-outs and rear wall cut-outs are provided which make it possible to rotate the stacking basket in the filling position when the lowering fork 24 is already located in the upper waiting position. It will be understood that the remaining design of the upper region of the stacking basket 7 is adapted in a corresponding manner.

The lowering speed of the lowering fork 24 is controllable in dependence on the speed of the overlapping stream, with the functional sequence of the prestacking rake also being included in the sequence control.

As FIG. 1 shows, the binding unit 11 is arranged in the region of the pressing device 10 and is provided with a binding channel 49. The binding unit 11 is movable and its binding channel can be brought into engagement with the guide channel 42 at the rear wall of the stacking basket. The binding channel 49 has a substantially C-shaped guide track which, after reaching the binding position, is completed by the guide channel 42 to form a substantially closed, O-shaped track. The packaging tape 41' is introduced by means of a roller arrangement into the O-shaped track. In an alternative embodiment the packaging tape 41' can be blown into the O-shaped track of the binding unit by compressed air.

Figure 3:
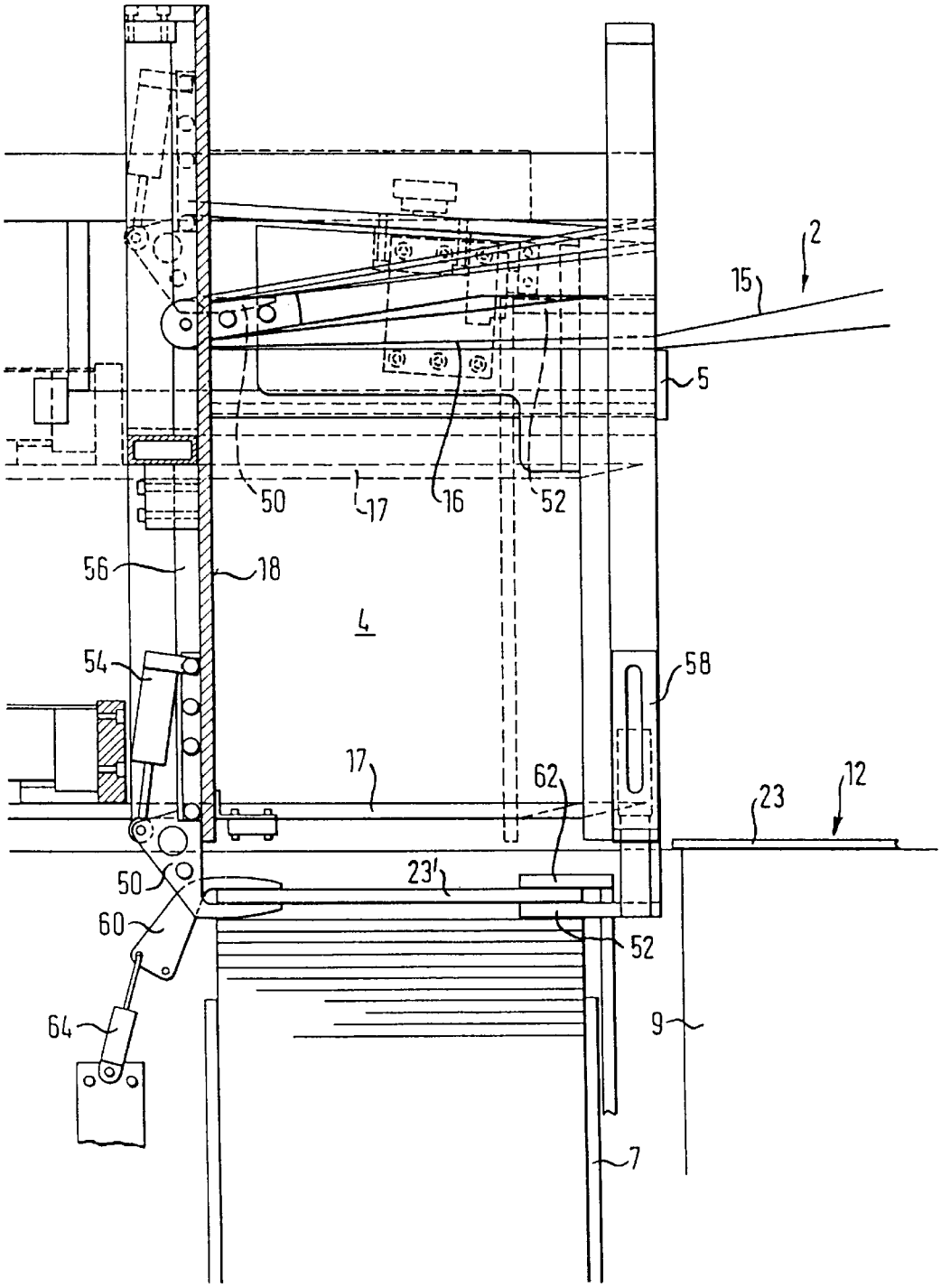
Figure 4:
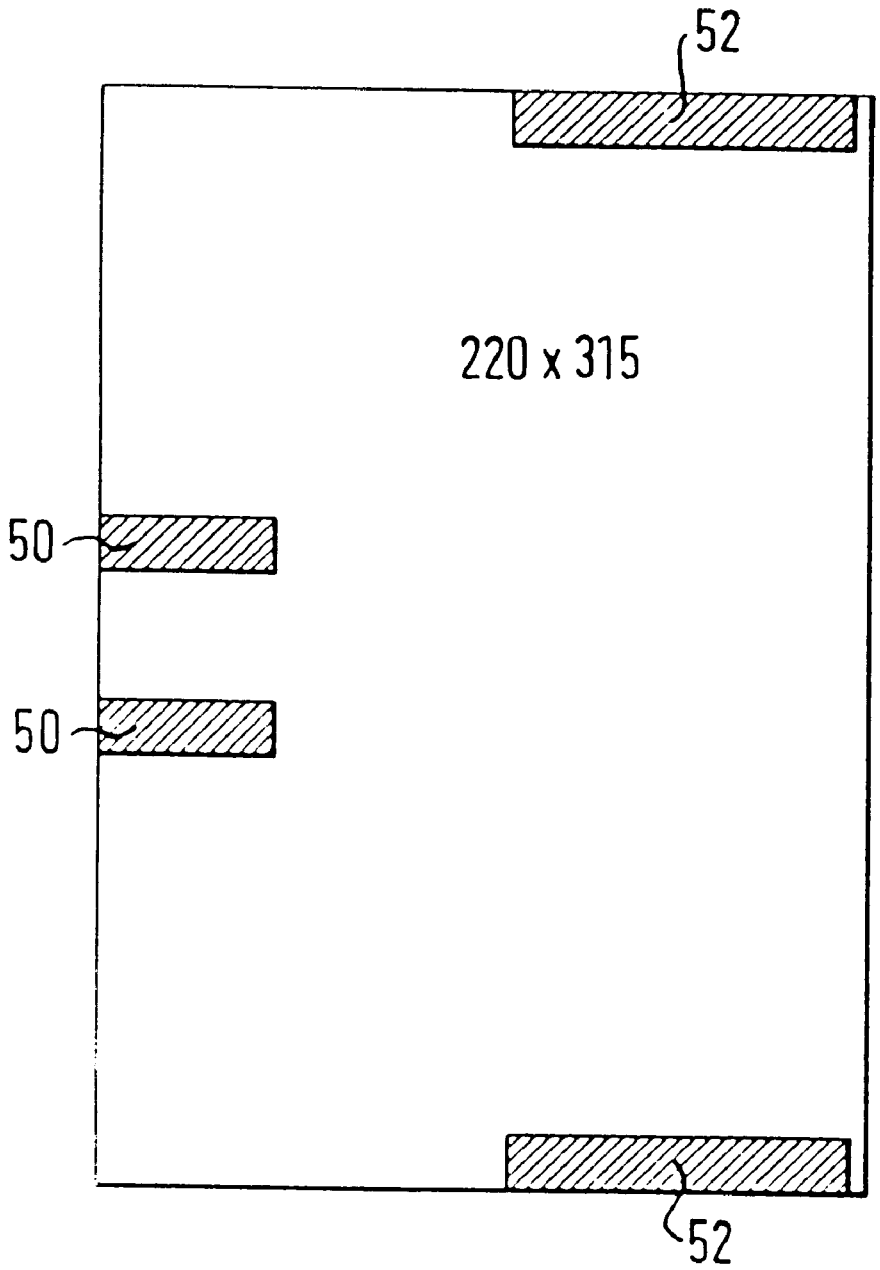

The holding down devices in accordance with the invention will now be described with reference to FIGS. 1 and 3. The apparatus shown in the Figures for the vertical stacking of printing products has a first holding down device in the region of the precollecting device 4 and also a second holding down device which is arranged on the carousel 6 in the region of the stacking baskets 7. As FIG. 3 shows, the first holding down device consists of a total of four hold-down members which are arranged at different sides of the collecting shaft 18. FIG. 4 schematically shows the arrangement of these four hold-down members relative to the collecting shaft 18 or relative to a product stack located in the collecting shaft. In this respect a specific product size is shown by way of example in FIG. 4. The size of this product can, however, vary because the walls of the collecting shaft 18 are adjustable, and with them the hold-down members 50, 52. Two hold-down members 50 are arranged at the left hand product side in FIG. 4, i.e. at the left hand side of the collecting shaft 18 in FIG. 3, symmetrically to the centre line, while two hold-down members 52 are so arranged at the two narrow sides that they adopt almost the largest possible spacing from the hold-down members 50.

As FIG. 3 shows, the hold-down members 50 at the fold sides of the products each consist of a substantially L-shaped hook whose vertically upwardly pointing side is made flat and whose vertically downwardly pointing side is of curved shape. The hook 50 is pivotable with the aid of a positioning cylinder 54 about a pivot axis and can be pivoted from the position shown in FIG. 3 out of the stacking region. Both hook-like hold-down members 50 are secured to a rail arrangement 56 and are movable vertically on the latter, i.e. axially in the collecting shaft. The path of movement thereby extends from the lower position shown in full lines in FIG. 3 to the upper position shown in broken lines.

The hold-down members 52 each consist of a plate pivotable in the horizontal plane and are likewise movable vertically or axially from the lowermost position shown in solid lines in FIG. 3 into the upper position shown in broken lines on a rail arrangement 58 parallel to the hold-down members 50.

As can be seen from FIG. 3, the hold-down members 50 and 52 of the first hold-down device are located in their lower position outside of the collecting shaft 18 and outside of the precollecting device 4. Moreover, these holding down devices are located beneath the end plate supply 12 which conveys end plates 23, 231 from a plate lift 9 into the stacking region. In their upper position shown in broken lines in FIG. 3, the hold-down members 50, 52 of the first holding down device are located above the product supply 2 in the region of the conveyor belt 15 or of the contact pressure belt 16. The two plate-like hold-down members 52 are pivotable in the horizontal plane out of their position corresponding to FIG. 4 so that they can be pivoted out of the stacking region in their lower position. Moreover, the hold-down members 50, 52 can be moved together with the walls of the stacking baskets 7.

The second holding down device, which is arranged on the carousel, is of the same design for both stacking baskets 7 and each consists of two hook-like hold-down members 60 and two plate-like hold-down members 62 which are displaced somewhat relative to the hold-down members of the first holding down device, but are however basically likewise so arranged as shown in FIG. 4. The design of the hold-down members 60 and 62 is comparable to that of the hold-down members 50 and 52, i.e. the hold-down members 60 are also pivotable out of the stacking region via positioning cylinders 64 and can be moved with the aid of a non-illustrated rail arrangement vertically downwardly out of the position shown in FIG. 3. The hold-down member 62 can also be pivoted sideways out of the stacking region. The hook-like hold-down members 60 of the second holding down device are, however, arranged in a mirror-symmetrical fashion to the hold-down members 50 of the first holding down device, i.e. the flat side of the hold-down member 60 comes into contact with the top side of the stack, or of the plates 23'should be mentioned again that the hold-down members 60 and 62 and also their displaceable and pivotable mounting is of the same design at both stacking baskets 7. As FIG. 3 shows, the axial path of movement of the second holding down device, i.e. of the hold-down members 60 and 62 extends beyond the upper rim of the stacking basket 7 and overlaps the path of movement of the first holding down device, i.e. of the hold-down members 50 and 52.

The manner of operation of the above described apparatus will now be explained.

As is shown in FIG. 1, the printed products are delivered in the form of an overlapping stream 14 horizontally, or at least substantially horizontally, and pass through the delay device 13. After the delay device the stream is conveyed in the run-in arrangement 2 into the precollecting device 4 with the aid of the conveyor belt 15. In the precollecting device 4 the rake 17 is ready in its upper operating position illustrated in broken lines in FIGS. 1 and 3 in order to move into an irregularity produced in the overlapping stream 14 by the delay device 13. From this moment on, the free stacking space above the rake 17 and below the contact pressure band 16 fills up until the product stream no longer freely falls into the prestacking basket 4 but is rather drawn into the stacking basket by the contact pressure band 16. At the same time the rake 17 is so lowered under the control of a sensor so that the contact pressure belt 16 pushes each further product onto the prestack. In this way the lowering of the rake is so controlled that the lowest possible pressure is exerted on the prestack in order to avoid smearing. During this whole filling process the shaker device 5 provided in the upper region of the precollecting device is operating. Since the contact pressure band 16 is resiliently suspended, it can be lifted vertically somewhat while the prestacking device 4 fills up. Basically, however, the control takes place in such a way that the layered arrangement of the products above one another takes place with a certain pressure within the collecting shaft 18 or within the precollecting device 4. This pressure is, however, minimized by the control so that the products admittedly lie horizontally on top of one another but are not, however, pressed together.

The sensor formed as a position sensor thus senses the position of the upper products and controls the lowering of the rake 17 and also the lowering of the lower lowering fork 24 accordingly and in dependence of the conveying speed of the product stream. When, namely, the rake 17 has reached its lower position, shown in continuous lines in FIGS. 1 and 3, it is moved back (to the left in the drawing) and hands over the prestack to the lower lowering fork 24 which is located in the position illustrated in broken lines in FIG. 1. Prior to this, an end plate 23 was placed onto the lowering fork 24 by the end plate dispensing device 12.

The rake 17 is moved upwardly again, with the aid of a pneumatic device, with the pile building process continually progressing during this time and with the lowering fork 24 continually being moved downwardly. Here the lowering also takes place in a positionally controlled manner so that the individual products in the pile admittedly lie horizontally on top of one another but in such a way that the lowest possible pressing pressure is maintained. After a desired number of products the delay device 13 (FIG. 1) acts on the product stream 14 in order to produce an irregularity or an interruption of the latter. Once the contact pressure band 16 has conveyed the last product of the pile to be formed into the collecting shaft, which is detected by a position detection system, the first holding down device is activated and the hold-down members 50, 52 are lowered out of their upper position illustrated in broken lines in FIG. 3, to such an extent that they contact the product lying at the top and hold it in a flat horizontal position. Once the hold-down members 50, 52 have passed the rake 17 which is located in its upper position, the latter moves into the collecting shaft 18 in order to collect the following products. At the same time the lowering fork 24 is lowered in synchrony with the first holding down device until the position shown in solid lines in FIGS. 1 and 3 has been reached. In this respect a situation in which the stack becomes distorted at its upper side is prevented by the first holding down device.

Once the pile which is formed is located in the position shown in FIG. 3, an end plate 23' is guided into the stacking region by the end plate supply device 12 so that it comes to lie on the hold-down members 50, 52, as shown in FIG. 3. Directly following this, the second holding down device of the associated stacking basket 7 is activated, so that the hold-down members 60 and 62 come to lie on the top side of the end plate 23'. Hereupon the hold-down members 50, 52 can be pivoted out of the stacking region and the lower lowering fork 24 can be lowered in synchrony with the second holding down device until the stack or the pile is located completely within the stacking basket 7. In this position the lower lowering fork 24 is removed downwardly from the carousel (see FIG. 1). The hold-down members 60, 62 of the second holding down device, however, remain activated.

As the next step the carousel is rotated at a high speed so that an empty stacking basket 7 takes the place of the full one. During this pivotal movement the pile in the stacking basket 7, however, remains extremely stable in shape because it is guided at all sides and is held at its top side by the second holding down device. As soon as the empty stacking basket 7 has entered into the filling position (and the filled stacking basket is located in the pressing station), the lowering fork 24 in the empty basket 7 is again moved upwardly in order to then receive the pre-stack in its waiting position after the laying in of an end plate 23. The described process then repeats continuously.

The pile located in the stacking basket 7 in the pressing and packaging position is pressed together by lowering of the pressing fork 47. In this arrangement the pressing force lies in the order of magnitude of 6000 N which lies high above the holding forces which can be exerted by the second holding down device. During the lowering of the pressing fork 47 the hold-down members 60, 62 of the stacking basket 7 are deactivated, i.e. are swung out of the stacking region and adopt a position in the right hand stacking basket indicated in FIG. 1. Following the lowering operation, or simultaneously with the latter, the binding device 11 moves into its operational position in which its guide channel for the packaging tape 41' enters into alignment with the guide channel 42 at the rear wall of the stacking basket. A packaging tape is now placed around the pile in the compressed state and the ends are secured to one another. After the banding the pressing fork 47 now travels upwardly and thus releases the pile. The side walls 39 are now pivoted away sideways so that a push-out device can expel the banded pile out of the stacking basket. The binding device now travels back and the empty stacking basket is rotated back into the filling position after the filling of the other basket.

In a modification of the sequence provision can be made for the side walls, rear walls and other components in the upper region of the stacking basket to be removed in a height range which corresponds to the waiting position of the upwardly moved lowering fork 24. In such an apparatus it is possible for the lowering fork 24 to travel upwards directly after the filled stacking basket has left the filling position so that it has already reached its waiting position before the empty stacking basket is rotated into the filling position.

With the aid of the apparatus of the invention a problem-free pile is formed which is aligned absolutely straight and which thus does not produce any waste during further processing. Since the pile is formed so straight that the products lie flat on top of one another, however, with the lowest possible pressure, a smearing of the printing ink is avoided during the introduction of the products into the prestacking device. Since an actual pressing of the stack first takes place in the pressing station in which the stack is already aligned and held in orderly manner, a correct stack formation is further favoured. In addition, a very high cyclical speed is possible through the guidance of the stack from all sides on the carousel and through the holding down of the stack during the transport from the collecting position to the pressing station, without the stack changing its shape. Finally, a very high operational safety can be ensured because the apparatus can be fully encapsulated so that no manual interference is possible or necessary. This reduces the danger of injury.

What is claimed is:

1. Apparatus for the vertical stacking of printed products comprising:

a precollecting device with a collecting shaft and a precollecting support;

a carousel having an outer periphery and a predetermined path of movement;

at least two stacking baskets arranged on the carousel and below the precollecting device for being shifted into communication with the shaft thereof;

a pressing fork which is arranged adjacent the periphery of the carousel and does not move with the carousel as it travels through its predetermined path of movement;

a first holding down device which is associated with the precollecting device; and a second holding down device which is arranged on the carousel, wherein the first and second holding down devices are movable in a vertical direction, with their respective paths of movement being in overlapping relation to each other.

2. Apparatus in accordance with claim 1, wherein the stacking baskets have an upper edge, and the path of movement of the second holding down device goes beyond the upper edge of the stacking baskets.

3. Apparatus for the vertical stacking of printed products comprising:

a precollecting device with a collecting shaft and a precollecting support;

a carousel having an outer periphery and a predetermined path of movement;

at least two stacking baskets arranged on the carousel and below the precollecting device for being shifted into communication with the shaft thereof;

a pressing fork which is arranged adjacent the periphery of the carousel and does not move with the carousel as it travels through its predetermined path of movement;

a first holding down device which is associated with the precollecting device; and a second holding down device which is arranged on the carousel, wherein the first holding down device is axially movable at least in the collecting shaft and the first and second holding down devices are movable in a vertical direction and include respective lower and upper end points in their paths of movement, and an end plate supply for supplying end plates is provided which is arranged above the lower end point of the first holding down device and above the upper end point of the second holding down device.

4. Apparatus in accordance with claim 3, wherein the end plates have a predetermined thickness, and the paths of movement of the first holding down device and of the second holding down device overlap by at least the thickness of an end plate.

5. Apparatus for the vertical stacking of printed products comprising:

a precollecting device with a collecting shaft and a precollecting support;

a carousel having an outer periphery and a predetermined path of movement;

at least two stacking baskets arranged on the carousel and below the precollecting device for being shifted into communication with the shaft thereof;

a pressing fork which is arranged adjacent the periphery of the carousel and does not move with the carousel as it travels through its predetermined path of movement;

a first holding down device which is associated with the precollecting device; and a second holding down device which is arranged on the carousel, wherein each holding down device has at least one laterally pivotable plate and at least one pivotable hook as a hold-down member.

6. Apparatus for the vertical stacking of printed products comprising:

a precollecting device with a collecting shaft and a precollecting support;

a carousel having an outer periphery and a predetermined path of movement;

at least two stacking baskets arranged on the carousel and below the precollecting device for being shifted into communication with the shaft thereof;

a pressing fork which is arranged adjacent the periphery of the carousel and does not move with the carousel as it travels through its predetermined path of movement;

a first holding down device which is associated with the precollecting device; and a second holding down device which is arranged on the carousel, wherein a control is provided which introduces the first holding down device into the collecting shaft when the stack has achieved its desired height.

7. Apparatus in accordance with claim 6, wherein the control first deactivates the first holding down device once the second holding down device has been actuated, and preferably after an end plate has been placed onto the first holding down device.

8. An apparatus for stacking printed products, the apparatus comprising:

a precollecting portion including a collecting shaft for receiving printed products and a precollecting support on which the printed products are supported in the shaft;

a stacking unit in which printed products are arranged in a stack and for being moved between a first predetermined position with the unit communicating with the precollecting portion for receiving printed products therefrom and a second predetermined position with the unit moved so that it does not communicate with the precollecting portion;

a first hold down device associated with the precollecting portion for being shifted in a first predetermined path to apply pressure to the stack of printed products at one end thereof; and a second hold down device associated with the stacking unit for being shifted in a second predetermined path that overlaps the first predetermined path to keep pressure on the one end of the printed product stack as the stack is transferred from the precollecting portion to the stacking unit.

9. The apparatus of claim 8 including a pressing fork at the second predetermined position of the unit and being shifted thereat into engagement with the end of the stack for increasing the pressure thereon as applied by the second hold down device for subsequent operations on the stack.

10. An apparatus in accordance with claim 8, wherein the first hold down device has a plurality of hold-down members which are arranged at different sides of the collecting shaft.

11. An apparatus in accordance with claim 8, wherein the second hold down device has a plurality of hold-down members which are arranged at different sides of the stacking unit.

12. An apparatus in accordance with claim 8, wherein the first hold down device is shiftable in and beyond the collecting shaft.

13. An apparatus in accordance with claim 12, wherein the first and second hold down devices are shifted vertically with their paths of movement including respective lower and upper end points of movement, and an end plate supply for supplying end plates is provided which is arranged above the lower end point of the first hold down device and above the upper end point of the second hold down device.

14. An apparatus in accordance with claim 13, where the end plates have a predetermined thickness, and the path of movement of the first hold down device and the path of movement of the second hold down device overlap by at least the thickness of an end plate.

15. An apparatus in accordance with claim 8, wherein the first hold down device can be shifted into a position above a product supply device.

16. An apparatus in accordance with claim 8, wherein the stacking unit has an upper edge, and the path of movement of the second hold down device extends beyond the upper edge of the stacking unit.

17. An apparatus in accordance with claim 8, wherein each hold down device has at least one laterally pivotable plate and at least one pivotable hook as a hold-down member.

18. An apparatus in accordance with claim 8, wherein a control is provided which introduces the first hold down device into the collecting shaft when the stack has achieved a desired size.

19. An apparatus in accordance with claim 18, wherein the control first deactivates the first hold down device once the second hold down device has been actuated, and after an end plate has been placed onto the first hold down device.

* * * * *